United States Patent [19]

Affaitati et al.

[11] Patent Number: 4,962,852

[45] Date of Patent: Oct. 16, 1990

[54] DOUBLE-CHAMBERED CONTAINER FOR LIQUIDS

[75] Inventors: Peitro Affaitati, Rome; Rosario Affaitati, Salerno; Luigi Sannino, Portici; Bruno Sannino, Caserta, all of Italy

[73] Assignee: IMS-International Medical Service S.r.l., Rome, Italy

[21] Appl. No.: 457,478

[22] Filed: Jan. 2, 1990

[30] Foreign Application Priority Data

Jan. 2, 1989 [EP] European Pat. Off. ..... 89830001.7

[51] Int. Cl.[5] ..... B65D 81/32; B65D 25/08

[52] U.S. Cl. ..... 206/222

[58] Field of Search ..... 206/219, 222

[56] References Cited

U.S. PATENT DOCUMENTS

| | | | |
|---|---|---|---|
| 3,603,469 | 9/1971 | Monza | 206/222 |
| 3,802,604 | 4/1974 | Morane et al. . | |
| 4,195,731 | 4/1980 | Cavazza | 206/222 |
| 4,773,529 | 9/1988 | Finke et al. | 206/222 |
| 4,793,475 | 12/1988 | Itzel | 206/219 X |

FOREIGN PATENT DOCUMENTS

| | | | |
|---|---|---|---|
| 090361 | 10/1983 | European Pat. Off. | 206/222 |
| 2453793 | 12/1980 | France | 206/222 |
| 2599006 | 11/1987 | France . | |
| 477334 | 10/1969 | Switzerland | 206/222 |
| 545730 | 2/1974 | Switzerland . | |
| 567978 | 10/1975 | Switzerland | 206/222 |
| 2019820 | 11/1979 | United Kingdom | 206/222 |

*Primary Examiner*—William I. Price

*Attorney, Agent, or Firm*—Browdy and Neimark

[57] ABSTRACT

A double-chambered container for liquids comprising a container on which a sealing member, showing a removable disposable bottom and which is able in turn to receive tightly an open bottomed tubular cartridge so that a hermetically closed chamber is formed, can be screwed, is described. The tubular cartridge is also equipped with a cap ending with a removable safety ring. Tearing off the safety ring the removable disposable bottom of the sealing member can be removed, connecting the chamber formed by the tubular cartridge and by the sealing member. The container according to the present invention is particularly suitable for tightly preserving liquids to be mixed upon use.

3 Claims, 2 Drawing Sheets

DOUBLE-CHAMBERED CONTAINER FOR LIQUIDS

Figure 1:
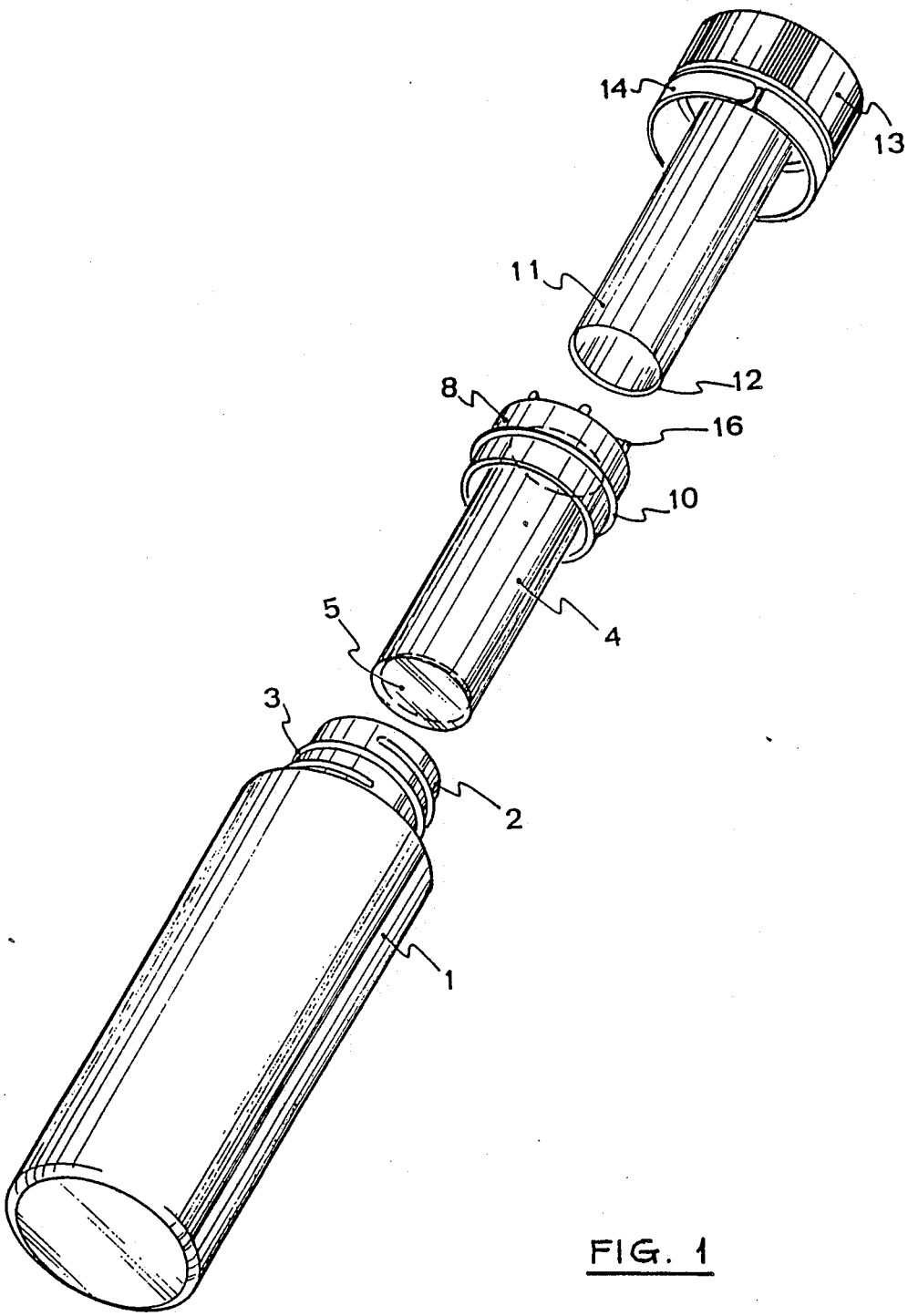

The present invention relates to a container formed by two chambers separated by a removable bottom which makes it possible to keep divided the liquids contained in these chambers and connect them upon use.

Various products are known which show a poor stability in time after their production by mixing. In order to prolong their stability, such products are made in situ by mixing of two or more powders and/or liquids. Among these glutaraldehyde can be cited, which, particularly in alkaline solution, is subject to polimerization phenomena which inhibit its activity. In acid solution glutaraldehyde is more stable, but it is not so biologically active as in alkaline solution. Therefore this product is generally sold for use in alkaline solution in two flasks, one containing glutaraldehyde and the other an alkaline buffer. The reaction occurring upon mixing produces an alkaline pH which preserves the biological activity of the glutaraldehyde for about thirty days, at the end of which the polimerization phenomena start. The mixing upon use shows, however, disadvantages due to the awkwardness of the flasks to be used.

Double-chambered containers, which have been expressly developed for substances to be mixed upon use, already belong to the state of the art. Generally these substances are pharmaceutical products and formulations containing a solvent solution and, isolated from this solvent solution, another substance in powder form. Upon use these two substances are mixed and the product is used. Double-chambered containers, containing two isolated liquids to be mixed upon use are not presently described in the state of the art. This is essentially due to problems of tightness which render difficult storage of two liquids for long periods in such containers.

It has now been surprisingly found that a double-chambered container essentially formed by a sealing member and a cartridge coupled together in a fluid-tight engagement and threaded on a container, can solve the problem of the sealed storage of liquids conferring moreover characteristics of handiness and ease of storage to the product thus obtained.

Subject of the present invention is therefore a double-chambered container for liquids, in plastic material, formed by a container equipped in the upper part with an open neck bearing a first thread, a shoulder and, in the lower part, with a closed bottom, characterized by the fact of comprising:

(a) a tubular sealing member having:

a disposable lower removable bottom, a flaring at the open upper end, a flange stretching outwards from said flaring, a cylindrical skirt stretching downwards from said flange and a second thread on the internal face of said cylindrical skirt engageable with said first thread, to take the edge of said neck in contact engagement with the lower surface of said flange and a first circular bead on the external face of said cylindrical skirt; and (b) an open bottomed tubular cartridge insertable with fluid-tight engagement inside said sealing member, said cartridge having a lower end open, an upper cap, a second circular bead placed on the inner surface of said cap and a safety ring removably connected at the bottom of said cap, said cartridge being able to occupy a first storage position, when said sealing member is screwed on said container, through said thread wherein it is able to receive in fluid-tight engagement said cartridge so that a hermetically closed chamber is formed, said chamber being defined by said cartridge and said bottom of the sealing member, said member and said cartridge being locked by the unidirectional engagement of said first and second beads and by the stop of said ring against the shoulder of the container, and a second position of use, after having torn the safety ring and pressed the cap, wherein the open end of the cartridge removes said bottom of the sealing member so that the liquids in said container and in said hermetically closed chamber are connected.

Two tables of drawings are enclosed with the present specification, wherein:

FIG. 1 shows an exploded view of the container according to the present invention;

FIG. *2a* shows a partial section of the container according to the present invention wherein the cartridge is in the storage position; and FIG. *2b* shows a partial section of the container according to the present invention wherein the cartridge is in the use position, wherein the liquid contained in the chamber and the liquid contained in the container are connected.

Figure 2:
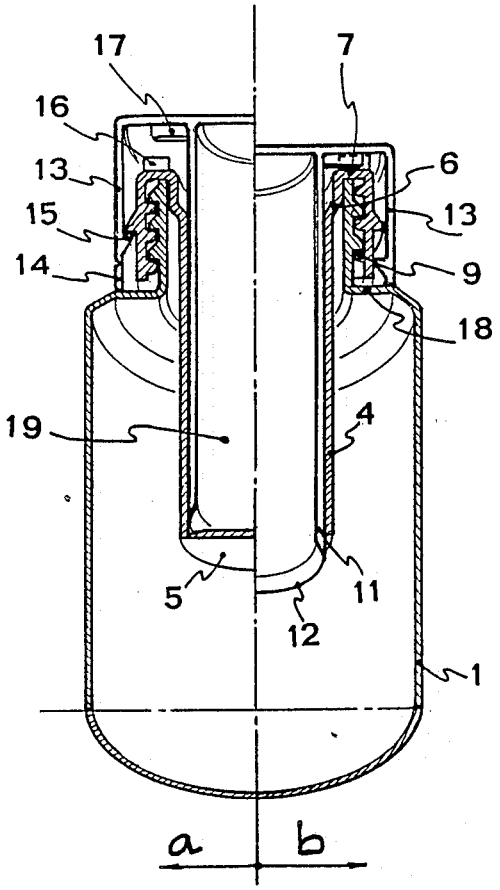

The present invention will now be described with particular reference to the FIGS. 1, 2 and *2a*. The container according to the present invention is formed by a container (1) equipped with a neck (2), on which a first thread (3) is made, and with a shoulder (18). The tubular sealing member (4) is closed at the lower end by a disposable removable bottom (5) while the upper end is open and shaped with a flaring (6) and merges into a flange (7) stretching outwards, which in turn merges into a circular skirt (8) stretching downwards. A second thread (9) engageable with the thread of the neck of the container is placed on the internal face of this cylindrical skirt. Upon screwing the tubular sealing member on the container the edge of the neck is taken into contact engagement with the lower surface of the flange so that the tubular member cannot go any further into the neck of the container. The circular skirt is equipped on its external face with a first circular bead (10), while on the external surface of said flange embossments (16) can be shaped for the manufacture and the automatic filling of the container according to the present invention. The tubular cartridge (11) shows the lower end (12) open and is equipped in the upper part with a cap (13). A second circular bead (15) is shaped on the internal face of the cap. A safety ring (14) is removably connected under this cap. The tubular cartridge is shaped so that it can be inserted in fluid-tight engagement within the sealing member. Under these conditions the inside of said cartridge and the bottom of the sealing member form a hermetical chamber (19) wherein upon preparation of the flask the liquid to be mixed with the liquid present in the container will be introduced. The container according to the present invention can guarantee the sealing of this chamber owing to the fluid-tight engagement between the sealing member and the cartridge. In a particularly preferred embodiment this fluid-tight engagement is realized through exact engagement between the external surface of the tubular cartridge and the internal surface of the sealing member. In addition to the sealing, also the closing of the container is assured according to the present invention after filling in with the liquids to be mixed upon use. On the one side the closing is assured by the unidirectional engagement between the first and the second circular bead which prevents the cartridge from moving off upwards. In fact, in a particular embodiment the two beads have the shape of a toothed saw in order to allow the elastic passage of the bead on the cap beyond the bead placed on the sealing member but not to allow the reverse passage. Such an elastic passage is also assured by the manufacture in plastic material of the container according to the present invention. On the other side the height of the safety ring prevents the same cartridge from moving downwards to reach the shoulder of the container, in this way provoking the mixing of the liquids. In fact, when said mixing of the two liquids has to take place, the safety ring is removed and a pressure on the cartridge causes its lower end to detach the removable disposable bottom of the sealing member connecting the liquid contained in the chamber (19) with the liquid contained in the container. To this purpose it is important that the lower end (12) of said cartridge is, in storage position, at a distance from the removable disposable bottom of the sealing member lower than the height of the safety ring. In the inside of the cap of the cartridge it is possible to shape second beads (17) for the mechanical manufacture of the finished container.

The container according to the present invention is preferably made of plastic material owing to reasons of build technique, as well as to ensure a certain elasticity to the cartridge to be used for the engagement of the two circular beads. Among the preferred materials PEHD (High Density Poliethylene) for the container and PP (polipropylene) for the cartridge can be cited.

As already stated, the present invention accomplishes various advantages in comparison with the embodiments belonging to the state of the art; among these advantages the following can be cited:

(1) an easiness of use for the operator who no longer has to work with more than one container to obtain the mixing; in addition this shows the advantage that the dosage is more precise, being mechanically predetermined, and the mixing is complete since the chamber and the container are perpendicularly superimposed;

(2) ease of storing since the container has reduced size and is ready for use; and (3) the hermetical separation for the first time accomplished in a double-chambered container for two liquids.

We claim:

1. Double-chambered container in plastic material for liquids formed by a container (1) equipped in the upper part with a neck (2) open, bearing a first thread (3), with a shoulder (18) and in the lower part with a closed bottom, characterized by the fact of comprising:

(a) a tubular sealing member (4) having:

a disposable lower removable bottom (5), a flaring at the open upper end (6), a flange (7) stretching outwards from said flaring, a cylindrical skirt (8) stretching downwards from said flange, a second thread (9) on the internal face of said cylindrical skirt, engageable with said first thread, to take the edge of said neck in contact engagement with the lower surface of said flange and a first circular bead (10) on the external face of said cylindrical skirt; and (b) an open bottomed tubular cartridge (11), insertable in fluid-tight engagement inside said sealing member, said cartridge having a lower end open (12), an upper cap (13) a second circular bead (15) on the internal surface of said cap, and a safety ring (14) removably connected in the lower part of said cap, said cartridge being able to occupy a first storing position when said sealing member is threaded on said container, through said thread, wherein it is able to receive in fluid-tight engagement said cartridge so that a hermetically closed chamber (19) is formed, defined by said cartridge and by said bottom of the sealing member, said member and said cartridge being locked by the unidirectional engagement of said first and said second bead and by the stop of said ring against the shoulder of the container, and a second position of use after having torn the safety ring and pressed on the cap, wherein the open end of the cartridge removes said bottom from the sealing member so that the liquids present in said container and said hermetically closed chamber are connected.

2. Container according to claim 1, wherein said fluid-tight engagement between said sealing member and said cartridge is accomplished through exact coupling between the external surface of said cartridge and the internal surface of said sealing member.

3. Container according to claim 1, wherein said first and second bead (10, 15) have the shape of a toothed saw, in order to allow the elastic passage of the bead placed on the cap beyond the relief placed on said sealing member, and not to allow the reverse passage.

* * * * *